US006540573B2

(12) United States Patent
Sato

(10) Patent No.: US 6,540,573 B2
(45) Date of Patent: Apr. 1, 2003

(54) COOLING SYSTEM FOR OUTBOARD MOTOR

(75) Inventor: Takayuki Sato, Shizuoka (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/838,903

(22) Filed: Apr. 19, 2001

(65) Prior Publication Data

US 2001/0039156 A1 Nov. 8, 2001

(30) Foreign Application Priority Data

Apr. 19, 2000 (JP) ..... 2000-117400

(51) Int. Cl.[7] ..... B63H 21/10
(52) U.S. Cl. ..... 440/88
(58) Field of Search ..... 440/88

(56) References Cited

U.S. PATENT DOCUMENTS 4,953,525 A 9/1990 Sakurai et al.
4,972,807 A 11/1990 Morishita
5,094,193 A 3/1992 Yoshikawa
5,109,809 A 5/1992 Fujimoto
5,803,036 A 9/1998 Takahashi et al.
5,873,330 A 2/1999 Takahashi et al.
5,983,843 A 11/1999 Suziki et al.
6,053,784 A 4/2000 Takahashi
6,184,599 B1 2/2001 Okabe et al.
6,244,915 B1 * 6/2001 Ozawa ..... 440/88

* cited by examiner

*Primary Examiner*—Jesus D. Sotelo
(74) *Attorney, Agent, or Firm*—Knobbe, Martens Olson & Bear LLP

(57) ABSTRACT

A marine drive comprises an engine having a cooling system adapted to cool the combustion chambers, air intake system, and the power generator. Intake coolant passages are formed on either side of the crankcase so as to lie adjacent reed valves that are positioned within the crankcase. Cooling water is directed through the intake cooling jackets in order to dissipate heat that may accumulate in the intake valves. Another cooling jacket is defined adjacent a portion of a flywheel magneto generator assembly. Cooling water is directed through this generator cooling jacket to absorb heat generated within the magneto coil of the generator. Accordingly, the magneto coil is protected further from damage that may occur if it is exposed to excessive heat. This arrangement has particular advantages with direct-injected, two-cycle engines in which no lubricant is directed across the intake valves.

30 Claims, 9 Drawing Sheets

COOLING SYSTEM FOR OUTBOARD MOTOR

PRIORITY INFORMATION

This application is based on and claims priority to Japanese Patent Application No. 2000-117400, filed Apr. 19, 2000 the entire contents of which is hereby expressly incorporated by reference.

BACKGROUND OF THE INVENTION

1. Field of the Invention

This invention relates to a cooling system for a marine drive. More particularly, the present invention relates to a cooling system for a plurality of engine components of a marine drive.

2. Description of Related Art

Typically, an outboard motor comprises an engine disposed atop a drive unit of the motor. To propel the associated watercraft, the engine drives a propulsion device placed in a submerged position through a proper drive mechanism. The engine usually has an engine body and a plurality of components. The engine body normally comprises a cylinder block, a cylinder head assembly and a crankcase assembly. At least one combustion chamber, and often more than one combustion chamber, is provided within the engine. Other engine components can include, for example, an air intake system, an exhaust system, a fuel supply system, and an electric power generator.

The engine body and components usually generate heat during engine operations. The heat can accumulate in the engine body and associated components unless properly removed, and excessive heat can jeopardize normal engine operations. Typical engines thus have a cooling system that can cool the heated portions of the engine body.

One type of cooling system takes water from the body of water in which the outboard motor is being operated and guides the water through cooling jackets formed in the engine body. The cooling water draws heat away from the engine body before being discharged from the engine.

Two cycle internal combustion engines are often employed in outboard motors. Such two cycle engines are typically lubricated by supplying lubricant through the engine's induction and porting system for lubricating the various moving components of the engine. Lubricant can be supplied in a wide variety of manners. For example, lubricant may be mixed with fuel, may be sprayed into the induction system of the engine, may be delivered directly to certain components of the engine, or may be supplied by any combination of the above.

In conventional two cycle engines, air from an air intake system travels through reed valves into a crankcase chamber of the engine. Air from the crankcase chamber then is supplied to the cylinders for combustion. Typically, fuel such as gasoline is mixed with lubrication oil and supplied to the air flow on an upstream side of the reed valves. The viscosity of this fuel/lubricant mixture is low in comparison with a typical lubricant alone. Because of its low viscosity, the mixture is easily sprayed and distributed to various parts of the engine for lubrication. The flow of the fuel/lubricant mixture across the reed valves also helps to cool the reed valves.

In order to reduce unburned hydrocarbons and engine exhaust emissions, and to increase engine performance, many internal combustion engines now employ direct fuel injection, wherein the fuel is directly injected into the cylinders. In these engine arrangements, the fuel is not mixed with lubricant. As a result, the viscosity of the lubricant is increased and consequently it is more difficult to deliver and distribute lubricant in the engine. Due to its high viscosity, lubricant particles tend to stick together during distribution. To avoid interference with the operation of the reed valves, the lubricant can be injected into the crankcase downstream of the reed valves and/or can be delivered directly to certain components. However, if lubricant does not flow across the reed valves, the reed valves may not be able to dissipate heat and may become excessively hot.

Accordingly, there is a need in the art for a two-cycle, fuel-injected engine having a cooling system that cools the engine intake system, as well as other engine components.

SUMMARY OF THE INVENTION

In accordance with one aspect, the present invention provides a marine drive comprising an internal combustion engine adapted to drive a propulsion unit. The engine comprises an engine body that at least partially encloses a crankshaft and has at least one combustion chamber. The engine further comprises an air intake system, a cooling system comprising a plurality of water jackets, and a flywheel generator. The cooling system has a coolant inlet and a coolant passage. The coolant passage delivers coolant to an intake system water jacket, which is arranged generally adjacent to the intake system, and to a combustion chamber water jacket, which is arranged generally adjacent to the at least one combustion chamber. The intake system water jacket and the combustion chamber water jackets are connected in parallel via the coolant passage so that water from one of the combustion chamber water jacket and intake system water jacket does not flow into the other of the combustion chamber water jacket and intake system water jacket. A generator water jacket is arranged adjacent at least a portion of the flywheel generator.

In accordance with another aspect of the invention, a marine drive comprises an internal combustion engine and a drive unit. The engine includes an engine body having a crankcase chamber, a substantially vertically oriented crankshaft at least partially enclosed within the crankcase chamber, a cooling system comprising a water jacket, a flywheel magneto generator, and an air intake system having at least one valve configured to selectively admit air into the crankcase chamber. The drive unit comprises a coolant inlet and a coolant passage. The coolant passage communicates coolant from the coolant inlet to the engine cooling system. The engine cooling system comprises an intake coolant jacket arranged adjacent the valve so as to direct a flow of coolant adjacent the valve, and a generator coolant jacket arranged adjacent at least a portion of the flywheel magneto generator so as to direct coolant adjacent the generator.

In accordance with yet another embodiment, the present invention provides a marine drive comprising an engine adapted to drive a propulsion device. The engine comprises a cylinder block defining at least one cylinder bore. A piston is arranged within the cylinder bore so as to reciprocate therein. A crankcase member defines, at least in part, a crankcase chamber at least partially enclosing a crankshaft and comprising an air guide portion having a valve for selectively allowing air to enter the crankcase chamber. A cylinder head is mounted onto the cylinder block. The cylinder head, cylinder bore and piston define a combustion chamber therebetween. A cooling system comprises a coolant supply passage configured so as to deliver coolant from a coolant source to an intake coolant jacket and to a cylinder head coolant jacket so that coolant is delivered to the intake coolant jacket independent of the cylinder head coolant jacket.

In accordance with a further embodiment, the present invention provides a marine drive comprising an internal combustion engine and a drive unit. The engine comprises an engine body at least partially enclosing a substantially vertically oriented crankshaft. The engine further comprises a flywheel magneto generator and a generator coolant jacket. The generator coolant jacket is positioned adjacent at least a portion of the generator. The drive unit comprises a coolant inlet and a coolant passage. The coolant passage communicates coolant from the coolant inlet to the generator coolant jacket.

In accordance with a still further embodiment, a marine drive comprises an internal combustion engine adapted to drive a propulsion unit. The engine comprises an engine body at least partially enclosing a crankshaft. A flywheel generator is mounted to the engine. Means for cooling the generator is positioned adjacent at least a portion of the generator.

Further aspects, features and advantages of this invention will become apparent from the detailed description of the preferred embodiments which follows.

BRIEF DESCRIPTION OF THE DRAWINGS

These and other features, aspects and advantages of the present invention will now be described with reference to the drawings of a preferred embodiment which is intended to illustrate and not to limit the invention. The drawings comprise 9 figures.

DETAILED DESCRIPTION OF THE PREFERRED EMBODIMENTS OF THE INVENTION

Figure 1:
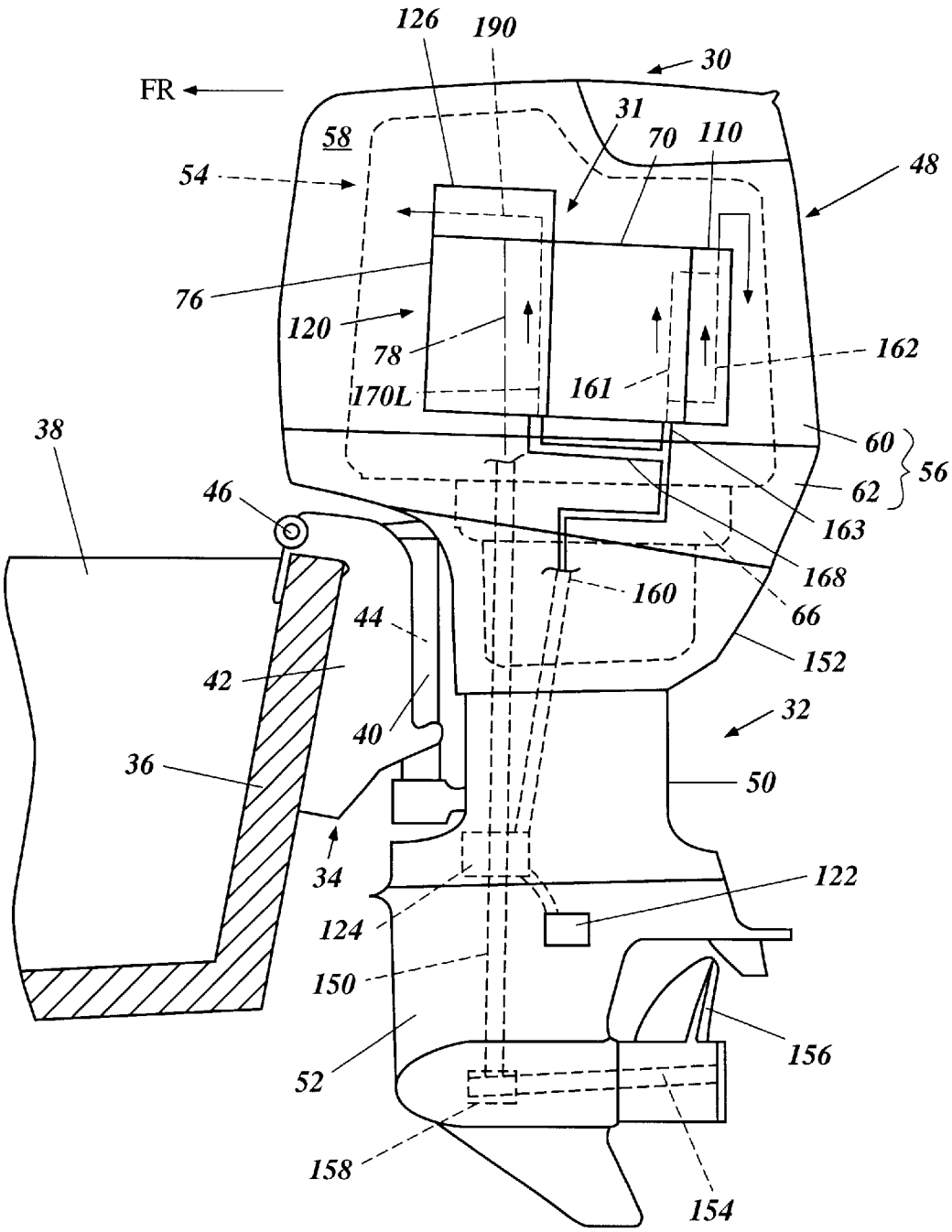
FIG. 1 is a side elevational view of an outboard motor comprising a cooling system configured in accordance with a preferred embodiment of the present invention. The cooling system is illustrated schematically in the figure and actual positioning of respective engine components can differ from those illustrated. A watercraft associated with the outboard motor also is partially shown in section.
Figure 2:
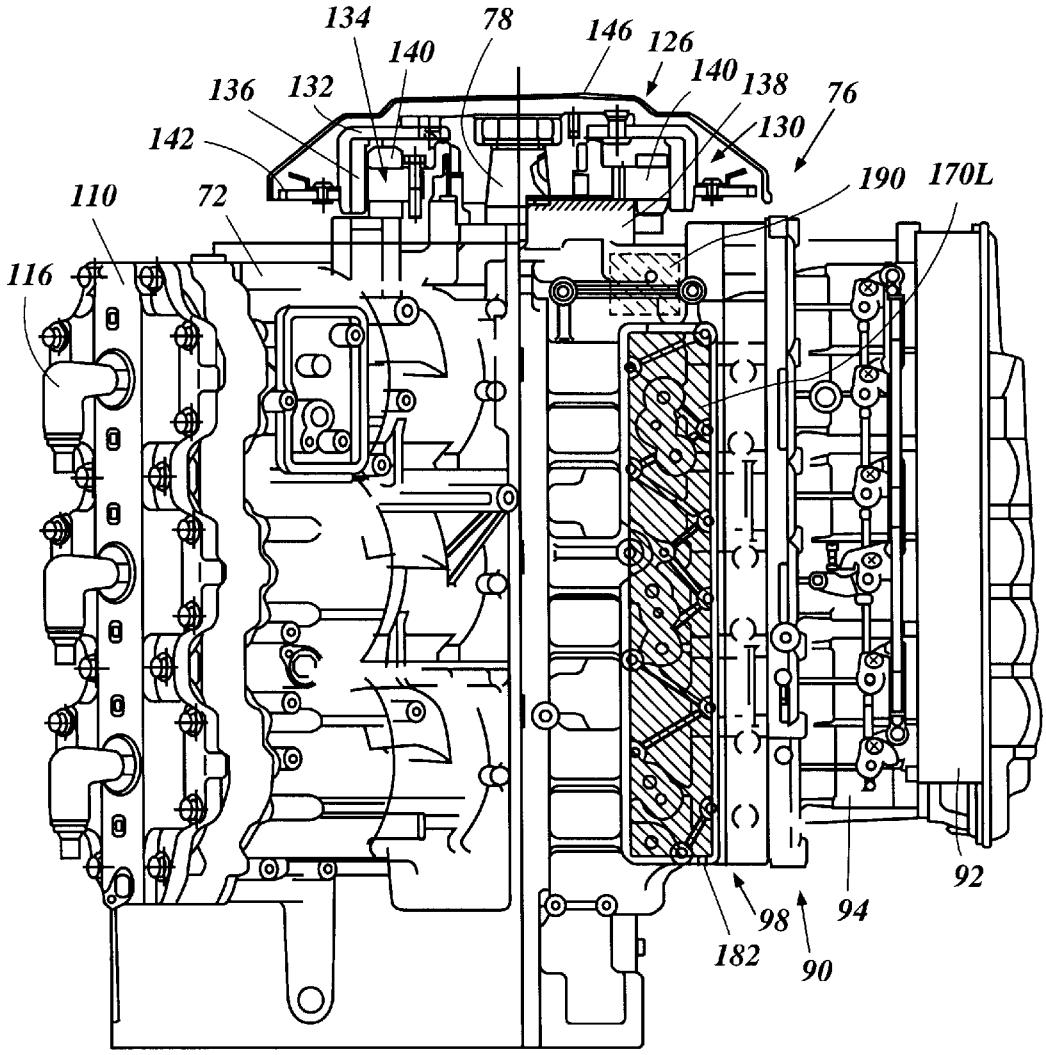
FIG. 2 is an enlarged port side view of the engine showing an intake cooling jacket and a generator cooling jacket as shaded areas and showing the flywheel magneto in cross section.
Figure 3:
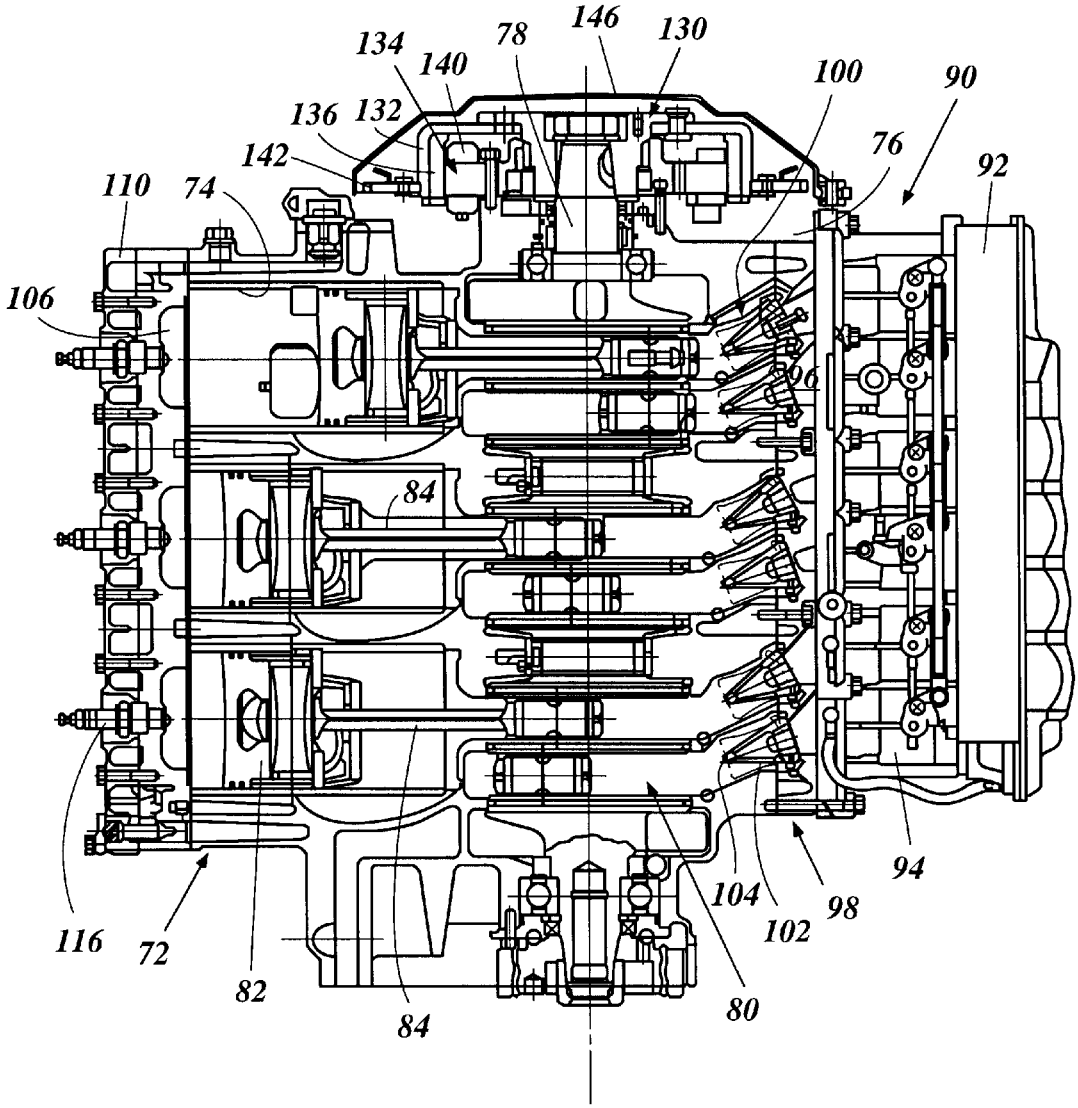
FIG. 3 is another enlarged port side view of the engine showing the engine in section so as to show the intake valves and the cylinder bores of a left bank of cylinders.

With reference to FIGS. 1–3, an overall construction of an outboard motor 30, which employs a cooling system 31 arranged in accordance with certain features, aspects and advantages of the present invention will be described. In the illustrated arrangement, the outboard motor 30 comprises a drive unit 32 and a bracket assembly 34. The bracket assembly 34 supports the drive unit 32 on a transom 36 of an associated watercraft 38 and places a marine propulsion device in a submerged position with the watercraft 38 resting on the surface of a body of water. The bracket assembly 34 preferably comprises a swivel bracket 40, a clamping bracket 42, a steering shaft 44 and a pivot pin 46.

The steering shaft 44 typically extends through the swivel bracket 40 and is affixed to the drive unit 32. The steering shaft 44 is pivotally journaled for steering movement about a generally vertically-extending steering axis defined within the swivel bracket 40. The clamping bracket 42 comprises a pair of bracket arms that are spaced apart from each other and that are affixed to the watercraft transom 36. The pivot pin 46 completes a hinge coupling between the swivel bracket 40 and the clamping bracket 42. The pivot pin 46 extends through the bracket arms so that the clamping bracket 42 supports the swivel bracket 40 for pivotal movement about a generally horizontally-extending tilt axis defined by the pivot pin 46. The drive unit 32 thus can be tilted or trimmed about the pivot pin 46.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system preferably is provided between the swivel bracket 40 and the clamping bracket 42 to tilt (raise or lower) the swivel bracket 40 and the drive unit 32 relative to the clamping bracket 42. Otherwise, the outboard motor 30 can have a manually operated system for tilting the drive unit 32. Typically, the term "tilt movement", when used in a broad sense, comprises both a tilt movement and a trim adjustment movement.

The illustrated drive unit 32 comprises a power head 48, a driveshaft housing 50 and a lower unit 52. The power head 48 is disposed atop the drive unit 32 and comprises an internal combustion engine 54 that is positioned within a protective cowling 56. Preferably, the protective cowling 56 defines a generally closed cavity 58 in which the engine 54 is disposed. The protective cowling 56 preferably comprises a top cowling member 60 and a bottom cowling member 62. The top cowling member 60 is preferably detachably affixed to the bottom cowling 62 by a coupling mechanism (not shown) so that a user, operator, mechanic or repair person can access the engine 54 for maintenance or for other purposes.

The top cowling 60 preferably has at least one air intake opening and at least one air duct disposed on its rear and top portion. Ambient air is drawn into the closed cavity 58 from within the opening through the duct.

With reference again to FIG. 1, the bottom cowling member 62 preferably has an opening at its bottom portion through which an upper portion of an exhaust guide member 66 extends. The exhaust guide member 66 is affixed atop the driveshaft housing 50. The bottom cowling member 62 and the exhaust guide member 66 together generally form a tray. The engine 54 is placed onto this tray and is affixed to the exhaust guide member 66. The exhaust guide member 66 also has an exhaust passage through which burnt charges (e.g., exhaust gases) from the engine 54 are discharged as described below.

With reference to FIGS. 2 and 3, the internal combustion engine 54 is preferably of a V-6 type and operates on a two-stroke crankcase-compression principle. Although the invention may be employed in conjunction with engines operating on other combustion principles and cycles, it will be readily apparent to those skilled in the art that it has particular utility with two stroke engines because of the arrangement of intake valves of such engines. It is to be understood that the actual number of cylinders and the cylinder configuration may vary. For example, an inline four cylinder engine or a single-cylinder engine may appropriately employ certain aspects of the invention.

Additionally, the illustrated embodiment describes the internal combustion engine being used in conjunction with an outboard motor. It is to be understood that the present invention may advantageously be used with various types of marine drives, such as inboard and inboard/outboard drives.

The V-6 engine 54 preferably has a right (starboard) and left (port) side and includes a cylinder block 70 having a pair of angularly related cylinder banks 72, each of which includes three cylinder bores 74 formed therein. The cylinder bores 74 extend generally horizontally and are generally vertically spaced from one another. As used in this description, the term "horizontally" means that the subject portions, members or components extend generally parallel to the water line of the body of water wherein the associated watercraft is resting when the drive unit 32 is not tilted and is placed in the position shown in FIG. 1. The term "vertically" in turn means that portions, members or components extend generally normal to those that extend horizontally.

As is typical with V-type engine practice, the cylinders 74 in the cylinder banks 72 are staggered. Since FIGS. 2 and 3 show only a side view of the engine 54, only the left cylinder bank 72 is depicted in these figures.

The cylinder banks 72 are attached to a central crankcase 76 which houses a substantially vertically oriented crankshaft 78. The crankcase 76 is divided into crankcase chambers 80, one chamber corresponding to each of the cylinders 74. Each cylinder 74 includes a piston 82 supported within the cylinder and adapted for reciprocating movement. A piston pin rotatably attaches the piston 82 to a small end of a connecting rod 84. A large end of the connecting rod 84 is journaled onto a throw of the crankshaft 78.

With specific reference to FIG. 3, an air charge is supplied to each individual crankcase chamber 80 by an induction system 90. The induction system 90 includes an air inlet device 92 that draws atmospheric air from the closed cavity 58 within the protective cowling 56. A throttle body is 94 positioned in an air passage 96 and regulates the volume of air supplied. Valves 100 are positioned within an air guide portion 98 of the crankcase 76 and downstream of the throttle body 94. Various valve types can suitably be employed for the valve 100. Most preferably, the valves 100 comprise one-way valves. Each valve 100 preferably regulates and facilitates the passage of the air charge into the corresponding crankcase chamber 80. In the illustrated embodiment, the valves 100 comprise reed valves, each of which comprises a metallic piece 102 and a rubber valve seat 104. Each reed valve 100 opens or closes depending on the pressure inside the associated crankcase chamber 80. The reed valves open during the intake/compression process to allow air to enter the crank chamber, and close during the firing/scavenging process.

In a direct injected engine, fuel and/or lubricant is not necessarily injected into the intake passage 96 upstream of the reed valves 100. In the illustrated direct injected engine 54, substantially no lubricant flows past the reed valves 100. Instead, lubricant is inserted into the crankcase 76 at locations downstream of the reed valves 100 and/or is delivered directly to engine components. Since lubricant does not flow over the reed valves 100, which flow would cool the valves, heat can accumulate in the valves during reed valve operation. Heat accumulation becomes especially acute during high load-high speed operation wherein the reed valves 100 open wide and at high frequencies. If excess heat accumulates, the metallic valve 102 and rubber valve seat 104 may become damaged. As discussed below in more detail, the illustrated cooling system 31 helps to avoid heat accumulation in the reed valves.

Figure 4:
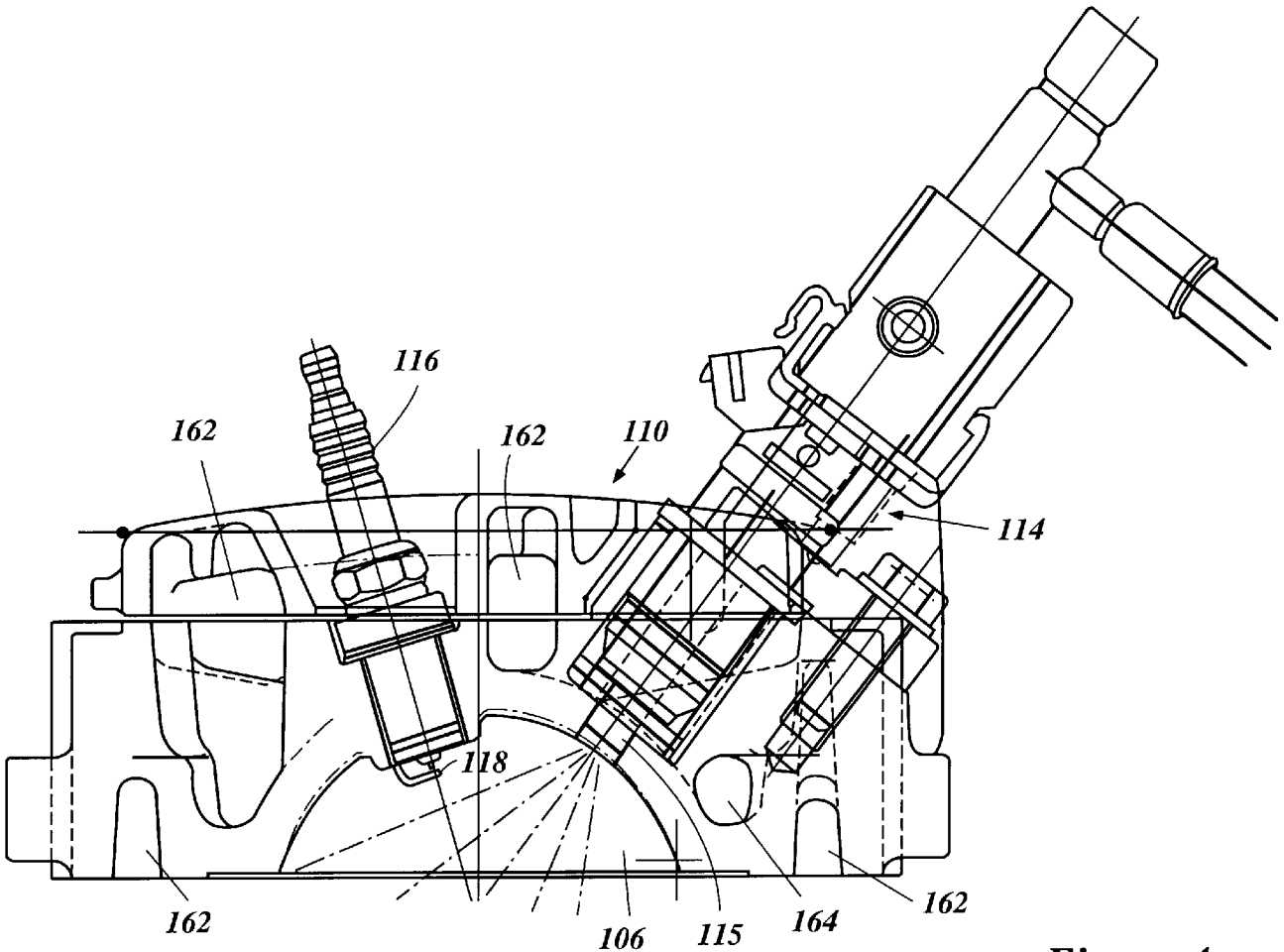
FIG. 4 is an end view of a cylinder head, showing the location of the combustion chamber and the placement of the spark plug and fuel injector.

Air from each crankcase chamber 80 travels through scavenge passages formed in the cylinder block 70, through scavenge ports and into a combustion chamber 106 formed between the piston 82, cylinder bore 74 and a cylinder head assembly 110 (see also FIG. 4). It is to be understood that any suitable scavenge system with any number of scavenge passages per cylinder may be used in a manner known in the art.

The engine 54 also comprises an exhaust system that discharges the burnt charges or exhaust gases from the combustion chambers to a location outside of the outboard motor 30. An exhaust manifold is preferably defined next to the cylinder bores 74 in the cylinder block 70 and communicates exhaust gases from the combustion chambers to the exhaust guide member 66. From the exhaust guide, gases are directed outside of the watercraft.

Fuel is preferably injected directly into each combustion chamber 106 by a fuel injector 114 disposed on the cylinder head 110 (see FIG. 4). Each fuel injector 114 preferably has an injection nozzle 115 directed into the associated combustion chamber. The fuel injector 114 also preferably has a plunger that closes the nozzle 115 and a solenoid coil that moves the plunger from the closed position to an open position when energized with electric power.

It is to be understood that other configurations can be employed to deliver fuel to the combustion chamber. For example, the fuel injector can be disposed on the cylinder block so that the nozzle is directed through a wall of the cylinder bore. Also, fuel can be injected into an intake manifold, scavenge passage, or the like. Further, some embodiments may employ a carburetor.

In the illustrated embodiment, the fuel injectors 114 spray fuel into the combustion chambers under control of an ECU (electronic control unit). The ECU controls energizing timing and duration of the solenoid coils so that the plungers open the nozzles to spray a proper amount of the fuel into the engine 54 during each combustion cycle. A fuel rail delivers fuel to the injectors 114.

The engine 54 further comprises an ignition or firing system. Each combustion chamber is provided with a spark plug 116 connected to the ECU so that ignition timing is also controlled by the ECU. The spark plugs 116 have electrodes 118 that extend into the associated combustion chamber 106 and that ignite an air/fuel charge in the combustion chamber at selected ignition timing. The ignition system preferably has an ignition coil and an igniter which are disposed between the spark plugs and the ECU. In order to enhance or maintain engine performance, the ignition timing can be advanced or delayed in response to various engine running conditions.

The ignition coil preferably is a combination of a primary coil element and a secondary coil element that are wound around a common core. Desirably, the secondary coil element is connected to the spark plugs, while the primary coil element is connected to the igniter. Also, the primary coil element is coupled with a power source so that electrical current flows therethrough. The igniter abruptly cuts off the current flow in response to an ignition timing control signal from the ECU and then a high voltage current flow occurs in the secondary coil element. The high voltage current flow forms a spark at each spark plug.

As discussed above, during engine operation, heat builds in the engine body 120, i.e., the cylinder block 70, the cylinder head 110, the crankcase 76 and various other engine components. The cooling system 31 is provided to help cool such engine portions and engine components.

With regard to the engine body 120, one or more water jackets preferably are provided that extend through or along side portions of the engine body 120 so that cooling water can remove at least some of the heat accumulating in the adjacent engine portions. In the illustrated open loop cooling system, the cooling water is drawn into the cooling system 31 through a water inlet 122 from the body of water surrounding the outboard motor 30 by a water pump 122. The water inlet 122 is disposed in a portion of the lower unit 52 that preferably is positioned under the water line at a level that will generally remain submerged when the drive unit 32 is fully or almost fully tilted down. The water pump 124, in turn, is disposed in the driveshaft housing 50. After flowing through the water jackets, the cooling water is returned to the body of water through a discharge port or by being directed into the exhaust system. The cooling system will be described in more detail below.

A flywheel assembly 126 preferably is positioned above the engine body 120. The illustrated flywheel assembly 126 comprises a flywheel magneto or AC generator 130 that supplies electric power to various electrical components such as the fuel injection system, the ignition system and the ECU. The flywheel magneto 130 generally comprises a rotor 132 and a stator 134 and can be constructed in any suitable manner.

In the illustrated arrangement, the rotor 132 is positioned atop the crankshaft 78 and is mounted for rotation with the crankshaft 78. Preferably, the rotor 132 is configured as an overturned cup shape and is made of cast iron or another suitable material such that it has a relatively large mass. The large mass is desired, even though it is positioned at the top end of the engine 54, because the rotor 132 concurrently acts as a flywheel to smooth rotation of the engine. A plurality of magnets 136 are affixed to the inner side surface of the rotor 132. The magnets 136 are juxtaposed with each other but are spaced apart from one another to form gaps between the magnets 136.

The stator 134 is affixed to a mount base 138 that is mounted on the engine body 120. The stator 134 comprises a plurality of electrical coils 140 facing the magnets 136 on the rotor 132. When the rotor 132 rotates around the stator 134, the magnets 136 intermittently pass the electrical coils 140. Electric power is induced in the coils to generate electric power (i.e., AC power) by a well-known electromagnetic induction effect. The generated AC power preferably is rectified and is regulated by a rectifier-regulator and then is accumulated in a battery so that the electrical components comprising the fuel injection system, ignition system and ECU can use DC power. The battery is preferably placed in the hull of the watercraft 38.

During operation of the flywheel magneto generator 130, heat is generated within the magneto coil 140. If the heat does not dissipate from the coil 140, excessive heat may accumulate. This excessive heat could cause damage to the coil. For example, a resin part of the coil could at least partially melt. Such damage could decrease the generating efficiency of the magneto 130. Accordingly, it is preferred to allow heat generated within the coil 140 to dissipate. As described in more detail below, the cooling system 31 provides additional cooling to help dissipate at least some of this heat.

The flywheel assembly 128 also comprises a ring gear 142 that extends around an outer surface of the illustrated flywheel assembly 126. A starter motor (not shown) preferably drives the crankshaft 78 to start the engine 54. The starter motor has a gear portion that meshes with the ring gear 142. To start the engine 54, the starter motor drives the crankshaft 78 through the gear connection. Once the engine 54 starts, the starter motor immediately preferably is disengaged to reduce the likelihood that the starter mechanism will be damaged.

A protective cover 146 is detachably mounted atop the engine body 120 to extend over at least a portion of the flywheel assembly 126. The protective cover 180 is useful to protect the flywheel assembly 126, which includes moving parts, when the top cowling 60 is detached.

As seen in FIG. 1, the driveshaft housing 50 depends from the power head 48 and supports a driveshaft 150 which is driven by the crankshaft 78. The driveshaft 150 extends generally vertically through the driveshaft housing 50. The driveshaft 150 preferably drives the water pump 124. The driveshaft housing 50 also defines internal passages which form portions of the exhaust system. An apron 152 covers an upper portion of the driveshaft housing 50 and improves the overall appearance of the outboard motor.

The lower unit 52 depends from the driveshaft housing 50 and supports a propulsion shaft 154, which is driven by the driveshaft 150. The propulsion shaft 154 extends generally horizontally through the lower unit 52. A propulsion device is attached to the propulsion shaft 154 and is powered through the propulsion shaft 154. In the illustrated arrangement, the propulsion device is a propeller 156 that is affixed to an outer end of the propulsion shaft 154. The propulsion device, however, can take the form of a dual counter-rotating system, a hydrodynamic jet, or any of a number of other suitable propulsion devices.

A transmission 158 preferably is provided between the driveshaft 150 and the propulsion shaft 150. The transmission 158 couples together the two shafts 150, 154, which lie generally normal to each other (i.e., at a 90° shaft angle) with bevel gears. The outboard motor 30 has a switchover or clutch mechanism that allows the transmission 158 to change the rotational direction of the propeller 156 among forward, neutral or reverse.

The lower unit 52 also defines an internal passage that forms a discharge section of the exhaust system. At engine speeds above idle, the exhaust gases generally are discharged to the body of water surrounding the outboard motor 30 through the internal passage and finally through an outlet passage defined through the hub of the propeller 156. Of course, an above-the-water discharge can be provided for lower speed engine operation. The difference in the locations of the discharges accounts for the differences in pressure at locations above the waterline and below the waterline. Because the opening above the line is smaller, pressure develops within the lower unit 52. When the pressure exceeds the higher pressure found below the waterline, the exhaust gases exit through the hub of the propeller. If the pressure remains below the pressure found below the waterline, the exhaust gases exit through the smaller opening above the waterline.

As discussed above, the engine is enclosed within a cowling. In order to make the outboard motor as compact as possible, the engine and the cowling are sized so that there is very little free space available in the closed cavity 58 within the cowling 56. Heat within the cowling 56 is not easily evacuated from the limited free space. Thus, heat generated by the engine 54, and by engine components such as the flywheel assembly 126, can accumulate within the cowling. As already discussed, such heat accumulation can cause damage to engine components such as the flywheel magneto power generator 130 and the reed valves 100. Still further, and as known in the art, the cylinder block 70 and cylinder head 110 may sustain damage and/or may also spread excessive heat to other engine components, possibly damaging those components, if heat is not dissipated from the components. Accordingly, the cooling system 31 is adapted to address at least some of these issues by drawing heat away from certain engine components.

With continued reference to FIGS. 1–3 and with additional reference to FIGS. 4–9, the cooling system 31 will now be described in greater detail below. As described above, the cooling system 31 generally comprises the water inlet 122 through which cooling water is introduced into a water supply conduit 160, the water pump 124 pressurizing the water to the supply conduit 160, a set of one or more water jackets extending alongside or through the engine body 120 and at least one discharge conduit for discharging the water after it has passed through the water jackets.

Figure 5:
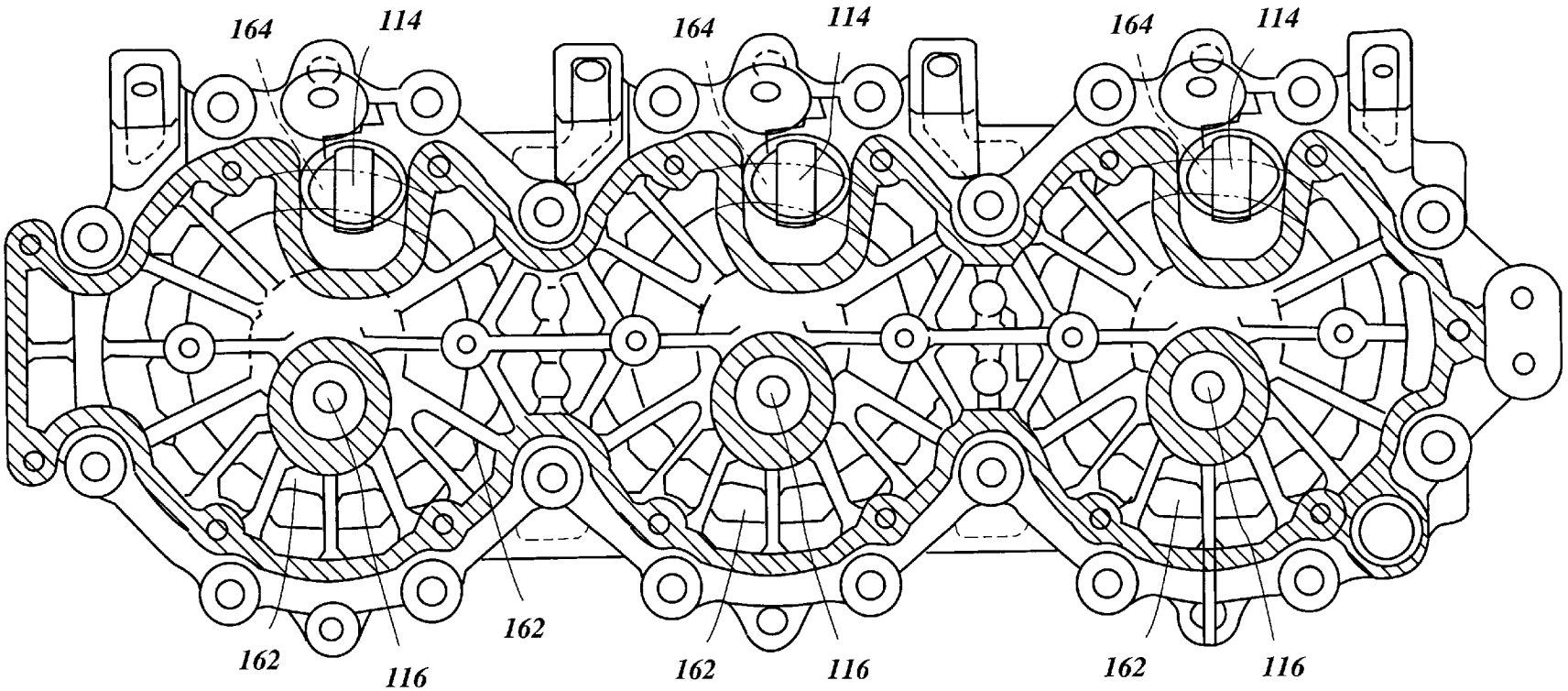
FIG. 5 is a top plan view of the cylinder head of FIG. 4, shown with the cylinder head cover removed and depicting a cooling jacket.

With specific reference to FIGS. 1, 4 and 5, a cylinder bore water jacket 161 and a cylinder head water jacket 162 substantially surround portions of the cylinder bores 74 and cylinder head 110, respectively. The water jackets 161, 162 are preferably integrally formed with both the cylinder block 70 and the cylinder head 110. In the illustrated embodiment, the cylinder bore water jacket 161 is formed in the cylinder block and is arranged to surround the cylinder bores 74. The cylinder head water jacket 162 is formed in the cylinder head 110 and is arranged to surround the spark plugs 116 and the fuel injectors 114. The cylinder heat water jacket 162 preferably is arranged so as to communicate with the cylinder bore water jacket 161 so that water flows from the cylinder bore water jacket 161 into the cylinder head water jacket 162. An injector coolant passage 164 branches off from the rest of the water jacket 162 to more thoroughly surround the associated fuel injector 114 and draw additional heat away from the injector.

Water from the water pump 124 flows through the water supply conduit 160 to a cylinder block coolant conduit 163 and into the cylinder bore and cylinder head water jacket 162. After passing through the cylinder bore and cylinder head water jacket 162, the water flows to a discharge.

With reference next to FIGS. 1, 2, and 6–9, a crankcase cooling supply conduit 168 branches off the water supply conduit 160 and delivers cooling water to water jackets that are at least partially formed integrally with the crankcase portion 76 of the engine body 120.

In the illustrated embodiment, a pair of intake water jackets 170L, 170R are formed on either side of the air guide portion 98 of the crankcase 76 and are positioned so as to lie adjacent the location of the reed valves 100. Each of the intake water jackets 170L, 170R comprises a pair of substantially vertical side walls 172 that extend outwardly from the crankcase 76. Top and bottom walls 174, 176 also extend outwardly and, together with the side walls 172, define an exterior wall of the intake water jackets 170L, 170R. A cover 178 engages the walls so as to enclose the water jacket 170L, 170R.

In another embodiment, the intake water jackets are formed as substantially hollow passages formed within the crankcase 76. It is to be understood that various forms of manufacture may be acceptable and that the intake coolant jackets can be entirely integrally formed with the engine body 120 or may be partially formed with the engine body and may be enclosed by a cover mounted on the water jacket portion.

Figure 6:
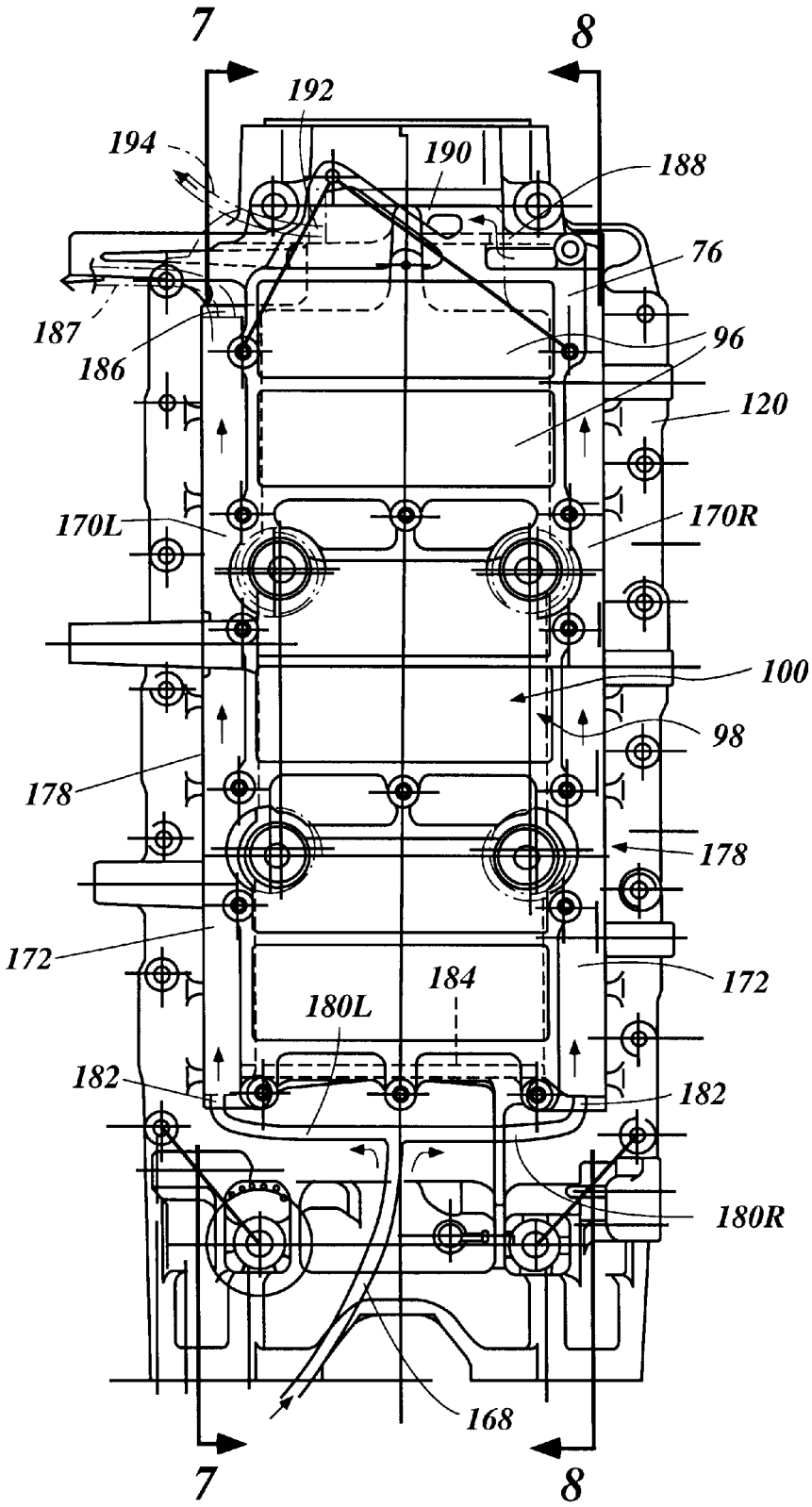
FIG. 6 is a front view of the engine of FIG. 2, shown with the air guide removed so that the intake cooling jackets can be viewed.
Figure 7:
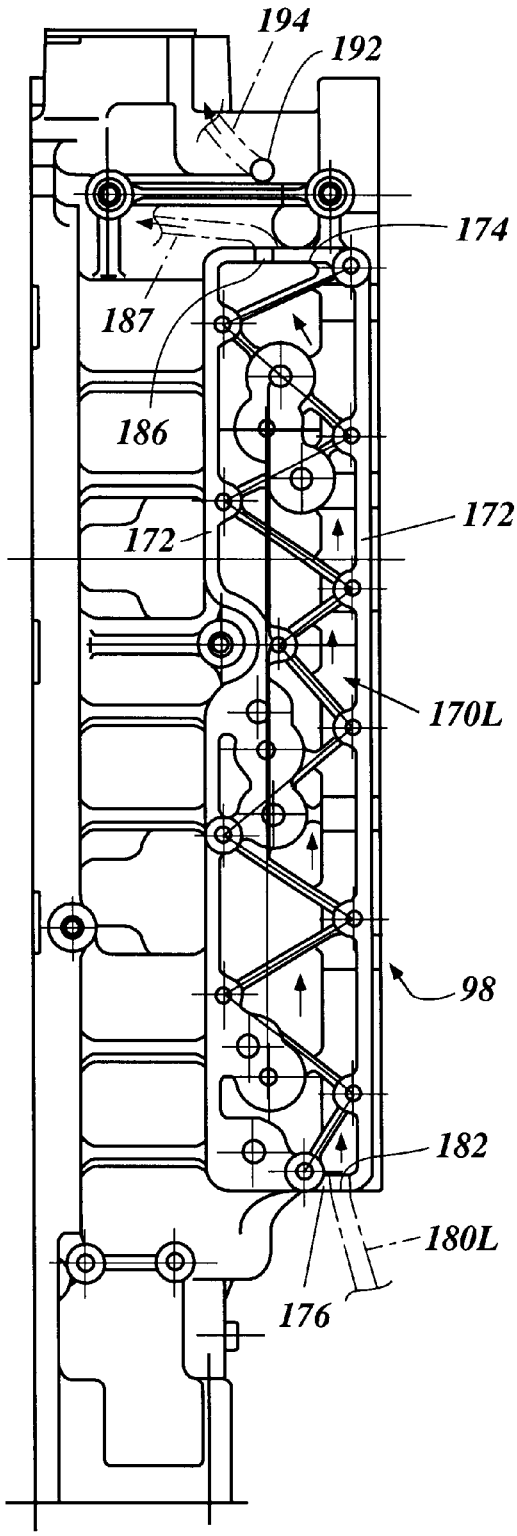
FIG. 7 is a sectional view of the left intake cooling jacket as viewed from line 7—7 of FIG. 6.
Figure 8:
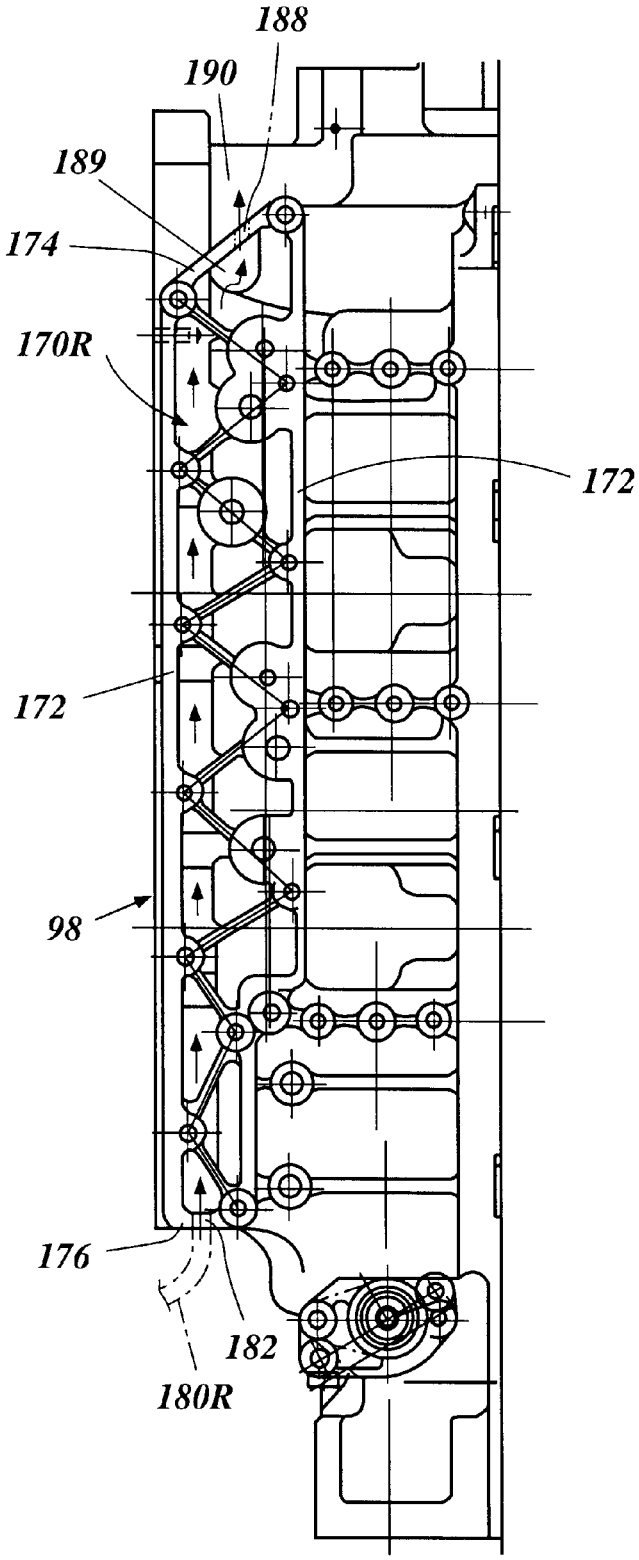
FIG. 8 is a is a sectional view of the right intake cooling jacket as viewed from line 8—8 of FIG. 6.

As shown in FIG. 6, the crankcase water supply conduit 168 branches into a left intake coolant conduit 180L and a right intake coolant conduit 180R. The left and right intake coolant conduits 180L, 180R deliver coolant through coolant inlets 182 formed through the bottom walls 176 of the left and right coolant jackets 170L, 170R, respectively. Coolant flows upwardly through the left and right intake water jackets 170L, 170R, drawing heat away from the reed valves 100 and thus preventing damage that may occur if the valves were to be subjected to excessive heat. With specific reference to FIG. 6, a connection passage 184 may be provided between the left and right intake cooling jackets 170L, 170R.

Cooling water that travels upwardly through the left intake cooling passage 170L exits the cooling jacket through an outlet 186 formed through the top wall 174 and is communicated via a tube 187 to a water discharge or to another part of the engine.

A connection hole 188 is formed through the top wall 174 of the right intake cooling jacket 170R and communicates the right intake coolant jacket 170R with a depression 189 formed in the crankcase 76. The depression 189 communicates water to a generator coolant jacket 190, which is also at least partially formed integrally with the crankcase 76. In this manner, coolant is supplied to the generator coolant jacket 190 without using external conduits.

Figure 9:
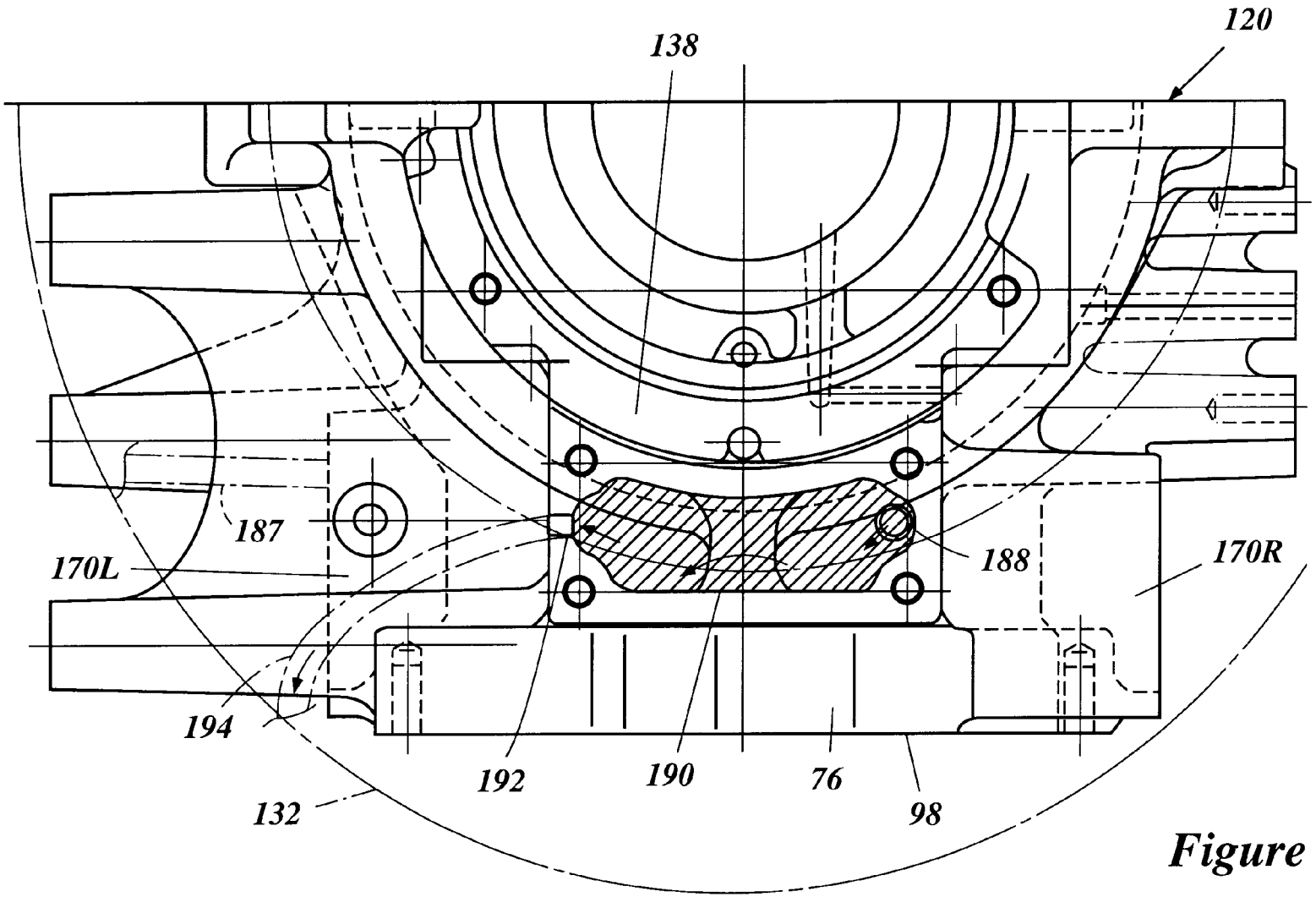
FIG. 9 is a top view of a portion of the engine, showing a generator cooling jacket as a shaded area and showing components of the flywheel magneto in phantom.

With specific reference to FIGS. 2, 6 and 9, the generator cooling jacket 190 comprises a depression or hollow portion formed in the crankcase portion 76 of the engine body 120 at a location generally adjacent the base 138 upon which the magneto coil 140 of the stator 134 is mounted. As with the intake coolant jackets, the generator cooling jacket 190 can be formed entirely within the crankcase 76 or can be partially formed in the crankcase and be closed by a cover member. Cooling water passing through the generator coolant jacket 190 removes heat from the magneto coil 140, thereby helping to prevent the magneto coil from sustaining the damage that may result from excessive heat.

The generator coolant passage 190 has an outlet hole 192 which communicates with a water drain tube 194. The water drain tube 194 communicates water from the generator coolant passage 190 to a water discharge or to another portion of the engine. As shown in FIG. 6, this arrangement allows cooling water to flow from right to left through the generator cooling jacket 190. Thus, by arranging the generator cooling jacket 190 so that water is supplied only from the right intake cooling jacket 170R, the flow path is simple, and the use of external coolant delivery conduits is minimized.

The above-described intake water jacket construction cools not only the reed valves, but also the general area of the crankcase that is associated with air intake. Thus, air is cooled while entering into the crankcase chamber 80. This is advantageous because cooled air increases the charging efficiency. In other words, higher temperature air is less dense than lower temperature air. Accordingly, by decreasing the temperature of the intake air, more air can be drawn into the combustion chambers to provide a better air to fuel ratio for more complete combustion or to provide more air, which can be mixed with more fuel to increase the power generated during combustion.

As described above, in the illustrated embodiment, the crankcase cooling conduit 168 branches off from the water supply conduit 160 so that water is supplied substantially directly from the water inlet 122 to the cylinder bore and cylinder head water jackets 161, 162 and to the intake cooling jacket 170L, 170R without first passing through other cooling jackets. Accordingly, the water supplied to both of these cooling jackets has not been heated before being supplied to the associated jacket. Accordingly, the use of external conduits is minimized because conduits are not required to run between the cylinder bore and/or cylinder head water jackets 161, 162 and the intake or generator cooling jackets 170, 190.

It should be appreciated, however, that in another embodiment, each of the above-discussed cooling jackets could have its own branched supply conduit. For example, instead of coolant passing through the right intake coolant jacket 170R before progressing to the generator coolant jacket 190, a branch passage could supply cooling water directly from the water inlet 122 to the generator coolant jacket 190. In another embodiment, the generator could be disposed in a different part of the engine such as, for example, on a lower part of the engine, and water could be directed through the generator coolant jacket prior to being directed into and through the intake coolant jackets.

In the illustrated embodiment, the cooling jackets and engine body are formed of an aluminum-based alloy. The aluminum alloy has excellent strength and heat transfer capabilities. However, it is to be understood that outboard motors are often used in corrosive environments, such as in salt water. Accordingly, in another embodiment, an inner pipe member or coating of brass can be embedded at desired locations within the cooling system, and even may comprise a lining of substantially the entire cooling jackets and conduits. Of course, other materials known for their heat transfer and resistance to corrosion can also be used as desired.

The foregoing description discusses several preferred constructions having certain features, aspects and advantages in accordance with the present invention. In addition, not all of the above-described components, features or aspects must be used in a single cooling system, and a cooling system can employ various components without employing other components. Still further, although the illustrated constructions were associated with a two-cycle, direct-injected engine, certain features, aspects and advantages can be appropriately used in connection with engines operating on different combustion principles or having different configurations. Thus, various changes and modifications may be made to the above-described arrangements without departing from the spirit and scope of the invention, as defined by the appended claims.

What is claimed is:

1. A marine drive comprising an internal combustion engine adapted to drive a propulsion unit, the engine comprising an engine body at least partially enclosing a crankshaft and having at least one combustion chamber, an air intake system, a cooling system comprising a plurality of water jackets, and a flywheel generator, the cooling system comprising a coolant inlet and a coolant passage adapted to deliver coolant to an intake system water jacket arranged generally adjacent to the intake system and to a combustion chamber water jacket arranged generally adjacent to the at least one combustion chamber, the intake system water jacket and the combustion chamber water jackets connected in parallel via the coolant passage so that water from one of the combustion chamber water jacket and intake system water jacket does not flow into the other of the combustion chamber water jacket and intake system water jacket, the cooling system additionally comprising a generator water jacket arranged adjacent at least a portion of the flywheel generator.

2. The marine drive of claim 1, wherein the generator water jacket is at least partially integrally formed with the engine body.

3. The marine drive of claim 1, wherein the intake system comprises at least one valve, and the intake system water jacket is arranged generally adjacent the at least one valve.

4. A marine drive comprising an internal combustion engine, the engine comprising an engine body having a crankcase chamber, a substantially vertically oriented crankshaft at least partially enclosed within the crankcase chamber, a cooling system comprising a water jacket, a flywheel magneto generator, and an air intake system having at least one valve configured to selectively admit air into the crankcase chamber, a drive unit comprising a coolant inlet, and a coolant passage communicating coolant from the coolant inlet to the engine cooling system, the engine cooling system comprising an intake coolant jacket arranged adjacent the valve so as to direct a flow of coolant adjacent the valve, and a generator coolant jacket arranged adjacent at least a portion of the flywheel magneto generator so as to direct coolant adjacent the generator.

5. The marine drive of claim 4, wherein the intake coolant jacket and the generator coolant jacket are both at least partially formed in the engine body.

6. The marine drive of claim 4 additionally comprising a connecting conduit extending between the intake coolant jacket and the generator coolant jacket.

7. The marine drive of claim 6, wherein the first coolant passage is arranged so as to communicate coolant to the intake coolant jacket, and coolant flows from the intake coolant jacket through the connecting conduit to the generator coolant jacket.

8. The marine drive of claim 4, wherein the flywheel magneto generator comprises a stator and a rotor, and the stator is mounted on the engine body and the rotor is mounted on the crankshaft.

9. The marine drive of claim 8, wherein the generator coolant jacket is arranged adjacent the stator.

10. The marine drive of claim 9, wherein the generator is mounted at an upper end of the engine.

11. The marine drive of claim 4, wherein a cylinder bore is defined within the cylinder block and a piston is positioned within the cylinder bore, and a cylinder head is mounted on the cylinder block, the the cylinder bore, piston and cylinder head defining a combustion chamber, a fuel injector being configured and arranged to inject fuel directly into the combustion chamber, and a cylinder head coolant jacket formed at least partially within the cylinder head and communicating with the coolant passage.

12. The marine drive of claim 11, wherein a branch passage from the coolant passage communicates with the cylinder head coolant jacket.

13. The marine drive of claim 11, wherein a portion of the cylinder head coolant jacket is arranged substantially adjacent the fuel injector.

14. A marine drive having a motor comprising an engine adapted to drive a propulsion device, the engine comprising a cylinder block defining at least one cylinder bore, a piston arranged within the cylinder bore to reciprocate therein, a crankcase member defining, at least in part, a crankcase chamber at least partially enclosing a crankshaft and comprising an air guide portion having a valve for selectively allowing air to enter the crankcase chamber, a cylinder head mounted onto the cylinder block, the cylinder head, cylinder bore and piston defining a combustion chamber therebetween, and a cooling system, the cooling system comprising a coolant supply passage configured so as to deliver coolant from a coolant source to an intake coolant jacket and to a cylinder head coolant jacket so that coolant is delivered to the intake coolant jacket independent of the cylinder head coolant jacket.

15. The marine drive of claim 14, wherein each of the intake coolant jacket and cylinder head coolant jacket have an inlet and an outlet, and the outlet of one of the intake coolant jacket and cylinder head coolant jacket does not communicate with the inlet of the other of the intake coolant jacket and cylinder head coolant jacket.

16. The marine drive of claim 14, wherein at least a portion of the cylinder head coolant jacket is integrally formed with the cylinder head and at least a portion of the intake coolant jacket is integrally formed with the air guide portion of the crankcase.

17. The marine drive of claim 14, wherein the coolant source is a body of water in which the marine drive is being operated, and wherein the cooling system comprises a discharge port for directing water from the cooling system back into the body of water.

18. The marine drive of claim 14, wherein the intake coolant jacket comprises a pair of side walls, a top wall and a bottom wall that extend outwardly from the air guide portion of the crankcase, and a cover engages the walls to define the intake coolant jacket.

19. The marine drive of claim 14, wherein the intake coolant jacket comprises a hollow passage formed in the air guide portion of the crankcase so as to be adjacent the check valve.

20. The marine drive of claim 14 additionally comprising a flywheel magneto, the flywheel magneto comprising a rotor and a stator, the stator being mounted on the crankcase, and a stator coolant jacket, at least a portion of the stator coolant jacket being integrally formed with the crankcase.

21. The marine drive of claim 20 additionally comprising a passage between the intake coolant jacket and the stator coolant jacket, wherein coolant flows through the intake coolant jacket and into the stator coolant jacket.

22. A marine drive comprising an internal combustion engine and a drive unit, the engine comprising an engine body at least partially enclosing a substantially vertically oriented crankshaft, a flywheel magneto generator, and a generator coolant jacket positioned adjacent at least a portion of the generator and comprising a chamber at least partially formed integrally with the engine body, the drive unit comprising a coolant inlet and a coolant passage, the coolant passage communicating coolant from the coolant inlet the generator coolant jacket.

23. The marine drive of claim 22, wherein the generator is mounted at an upper portion of the engine.

24. The marine drive of claim 22, wherein the generator comprises a rotor and a stator, and wherein the stator is mounted on a mount base on the engine body, and the generator coolant jacket is immediately adjacent the mount base.

25. A marine drive comprising an internal combustion engine and a drive unit, the engine comprising an engine body, a flywheel magneto generator, and a generator coolant jacket positioned adjacent at least a portion of the generator, the engine body at least partially enclosing a substantially vertically oriented crankshaft and having a crankcase, the crankcase including a crankcase chamber and having an air guide portion with a valve adapted to selectively admit air into the crankcase chamber, the air guide having a first side and a second side, and an air guide coolant jacket is arranged on each of the first and second sides of the air guide so as to lie adjacent the valve, the drive unit comprising a coolant inlet and a coolant passage, the coolant passage communicating coolant from the coolant inlet to the generator coolant jacket.

26. The marine drive of claim 25, wherein the first and second air guide coolant jackets are at least partially formed integrally with the air guide.

27. The marine drive of claim 26, wherein each of the air guide coolant jackets comprises an exterior wall extending generally outwardly from the air guide, and a cover engages the exterior wall so as to define the coolant jacket.

28. The marine drive of claim 27, wherein a coolant delivery conduit communicates coolant from the coolant inlet to an inlet formed through a bottom portion of the exterior wall of each of the first and second air guide coolant jackets.

29. The marine drive of claim 28, wherein the first and second air guide coolant jackets each have an outlet formed through an upper portion of the exterior wall, and a connector communicates between the second air guide coolant jacket outlet and the generator coolant jacket.

30. The marine drive of claim 29, wherein the first air guide coolant jacket outlet does not communicate with the generator coolant jacket.

* * * * *

UNITED STATES PATENT AND TRADEMARK OFFICE

CERTIFICATE OF CORRECTION

PATENT NO. : 6,540,573 B2
DATED : April 1, 2003
INVENTOR(S) : Takayuki Sato

It is certified that error appears in the above-identified patent and that said Letters Patent is hereby corrected as shown below:

Title page,
Item [75], Inventor, replace the inventor address to read -- Hamamatsu -- instead of "Shizuoka"

Signed and Sealed this

Twenty-third Day of September, 2003

JAMES E. ROGAN
*Director of the United States Patent and Trademark Office*